United States Patent [19]

Schmidt et al.

[11] Patent Number: 4,630,825

[45] Date of Patent: Dec. 23, 1986

[54] GOLF CLUBS

[75] Inventors: Glenn H. Schmidt, 1854 Los Encinos, Glendale, Calif. 91208; Howard F. Schmidt, S. Gate; Glenn R. Seidman, Palos Verdes, both of Calif.

[73] Assignee: Glenn H. Schmidt, Glendale, Calif.

[21] Appl. No.: 682,440

[22] Filed: Dec. 17, 1984

[51] Int. Cl.[4] ..... A63B 53/04

[52] U.S. Cl. ..... 273/167 H; 273/171; 273/77 A; 273/174; 164/35

[58] Field of Search ..... 273/167 H, 171, 172, 273/174, 169, 168, 173, 175, 77 A

[56] References Cited

U.S. PATENT DOCUMENTS

| | | | |
|---|---|---|---|
| 1,253,700 | 1/1918 | McLaughlin | 273/167 H |
| 3,220,733 | 11/1965 | Saleeby | 273/171 |
| 4,367,878 | 1/1983 | Schmidt | 273/175 |
| 4,429,879 | 2/1984 | Schmidt | 273/167 H |
| 4,465,221 | 8/1984 | Schmidt | 273/173 |
| 4,472,092 | 9/1984 | Schmidt | 273/169 H |

FOREIGN PATENT DOCUMENTS

| | | | |
|---|---|---|---|
| 488469 | 7/1938 | United Kingdom | 273/167 H |

*Primary Examiner*—George J. Marlo

*Attorney, Agent, or Firm*—William W. Haefliger

[57] ABSTRACT

A hollow metallic head having a ball striking front face and a bottom surface, (b) the head defining an opening between the hollow and the exterior, the opening located at the bottom of the head, the head having a heel and toe, (c) and a closure for that opening having elongated, tongue and groove, linear sliding connection with the head, the closure located at the bottom of the head, the closure directly exposed along its length to the head hollow above the closure, (d) the connection having a substantially T-shaped cross section, the closure being longitudinally elongated in the direction between the hell and toe, and the connection comprising two pairs of tongue and groove elements, each pair including a tongue element on the closure and a groove element on said head to limit inward displacement of the tongue elements, the closure having a lowermost outer surface everywhere spaced from the tongue and groove elements and flush with the head bottom surface at opposite sides of the closure lowermost outer surface, the closure entirely confined within the outer perimeter outline of the head.

14 Claims, 34 Drawing Figures

FIG. 30.
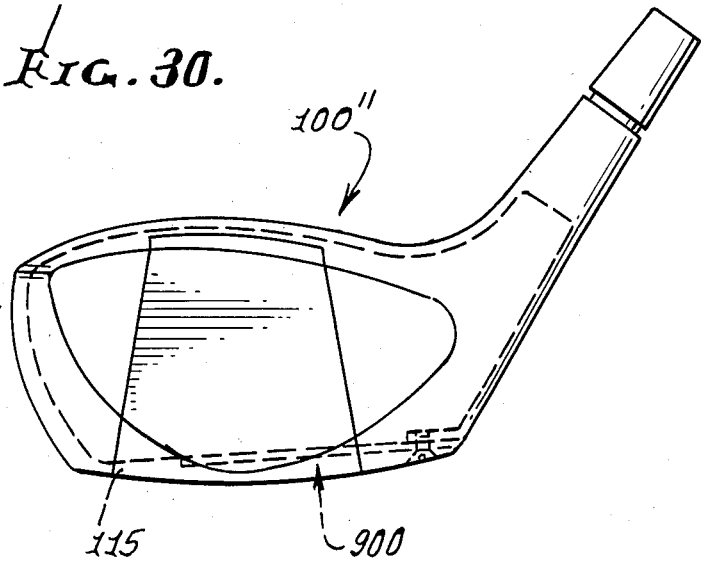
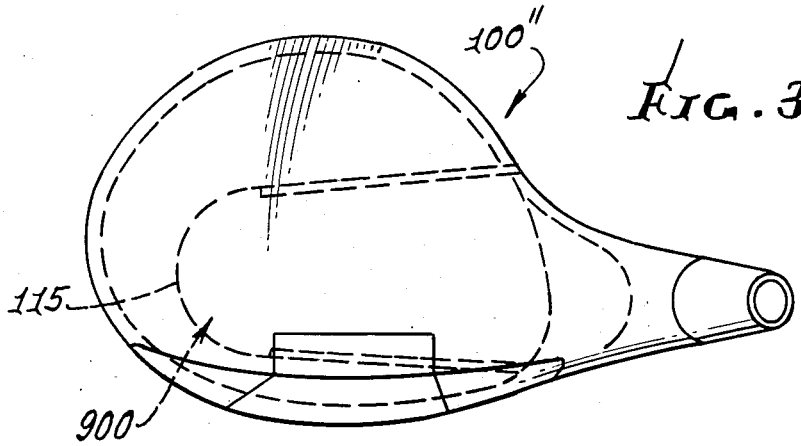
FIG. 31.
FIG. 32.
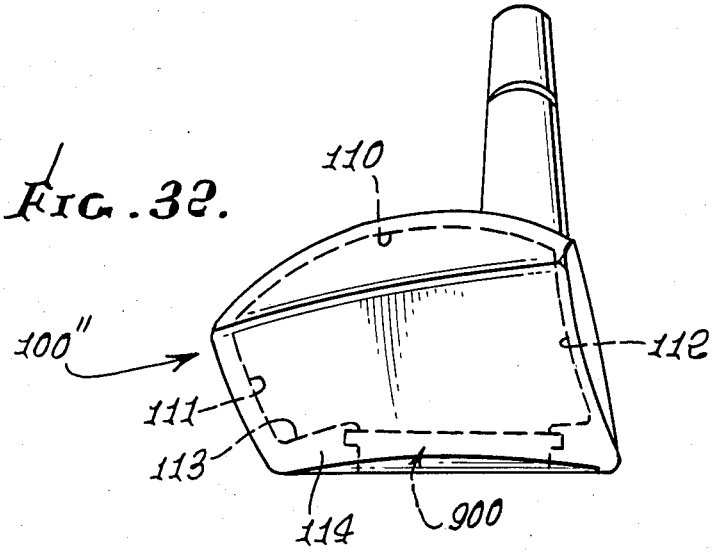

GOLF CLUBS

BACKGROUND OF THE INVENTION

This invention relates generally to the forming and construction of hollow gold club heads, and more particularly to hollow iron heads.

The use of hollow gold club heads is becoming more and more extensive, and there is a need for hollow head structures and method of forming same which facilitate mass production, as well as needed selective weighting of heads. In particularly, these needs have recently extended to the provision of satisfactory hollow iron heads, which are extremely difficult to produce in view of the narrow, blade-like configurations of such heads.

SUMMARY OF THE INVENTION

It is major object of the invention to meet the above needs, through provision of an improved head comprising:

(a) means defining a hollow metallic shell head having a ball striking front face, (b) the shell defining an opening between the hollow and the exterior, (c) and a closure for said opening having elongated, tongue and groove, linear sliding connection with said means.

It is a further object of the invention to provide a connection having a substantially T-shaped cross section to facilitate such sliding connection along the elongated length of the closure, the connection typically comprising two pairs of tongue and groove elements, each pair including one element on the closure and the other on said means.

It is a further object of the invention to provide such an elongated closure having weight means associated therewith; a closure consisting of brass where the iron head consists of stainless steel; and a closure made in slidable sections, as will appear.

Yet another object of the invention is to provide a novel and highly advantageous method to fabricate the described head, having a ball striking front face, a rear side, and a bottom surface which is elongated between the head toe and heel, the hollow formed between said front face and rear side and defining an opening to the exterior through said bottom surface, said opening being elongated lengthwise along said bottom surface, the steps that include:

(a) positioning multiple inserts to fill said hollow and opening, (b) forming wax about said inserts and to have an exterior in the shape of the head, (c) removing said inserts from said hollow and via said elongated opening at the bottom of the wax head, (d) and employing said wax head in the lost wax process to form a steel head.

As will appear, the method may advantageously include employing a temporary closure for said opening and forming said wax about said closure, and sliding said closure endwise, and relative to the wax to open said opening prior to said (c) step removal of the inserts.

These and other objects and advantages of the invention, as well as the details of an illustrative embodiment, will be more fully understood from the following specification and drawings, in which:

DRAWING DESCRIPTION

Figure 1:
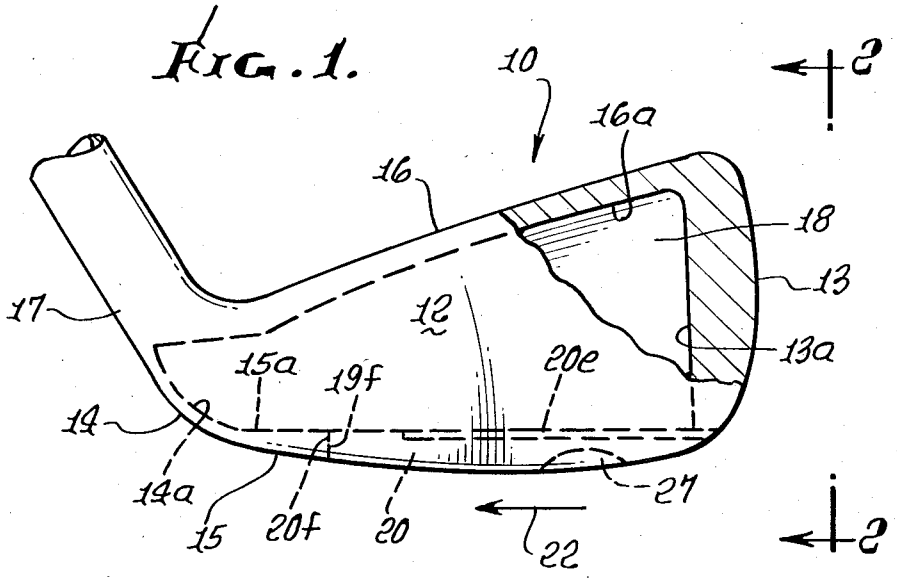
FIG. 1 is an elevational view of a rear side of a golf iron, incorporating the invention.
Figure 2:
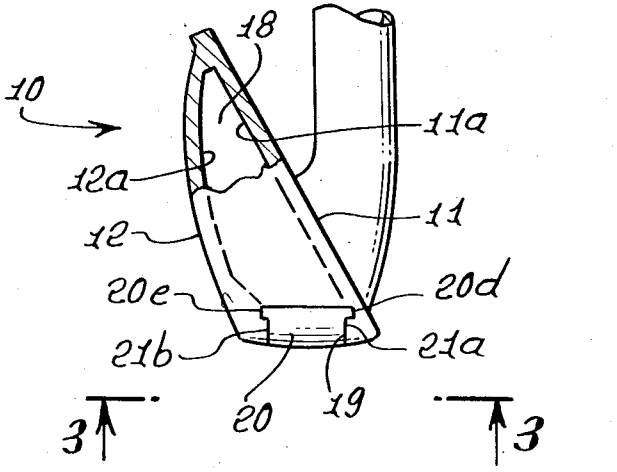
FIG. 2 is an end elevation taken on lines 2—2 of FIG. 1.
Figure 2A:
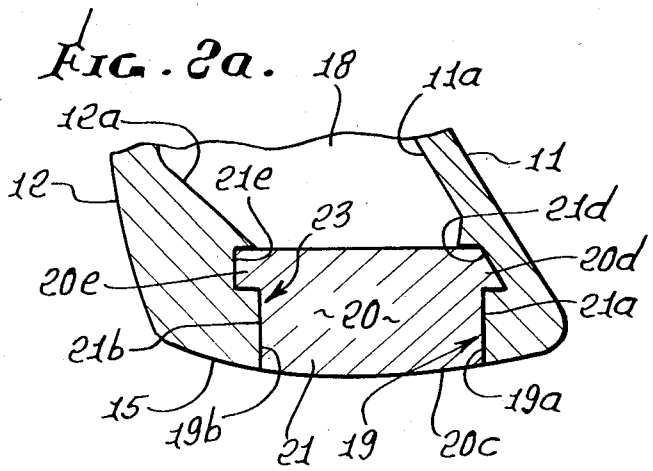
Figure 3:
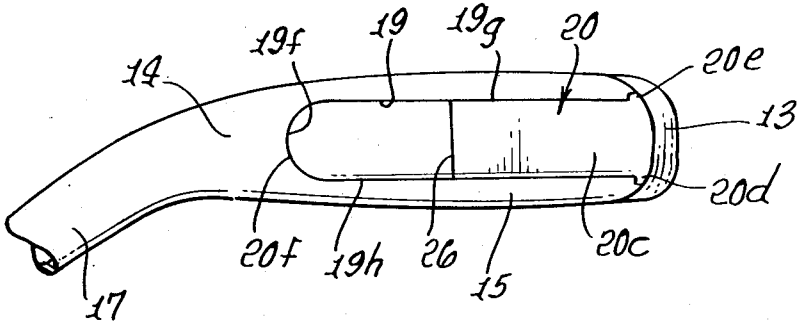
Figure 4:
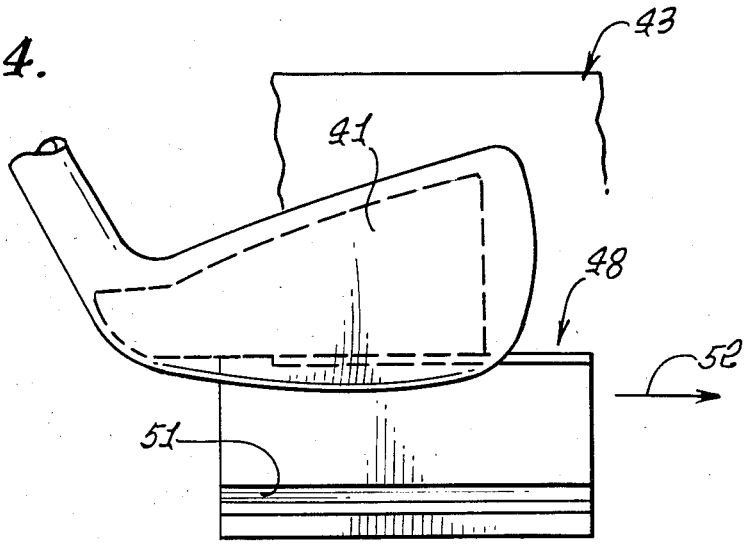
Figure 5:
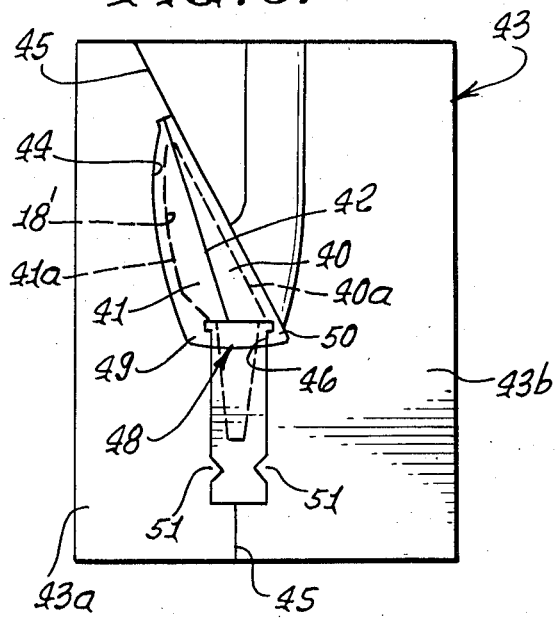
Figure 6:
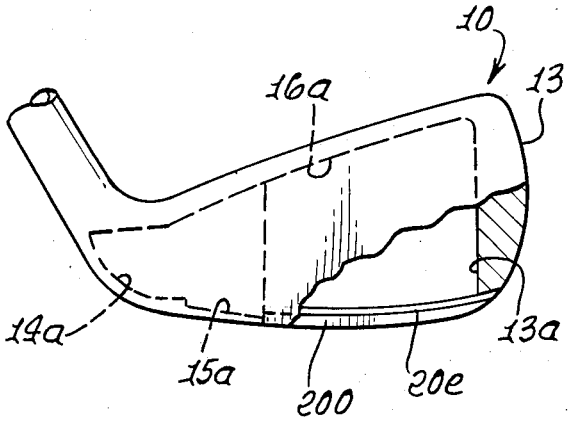
Figure 7:
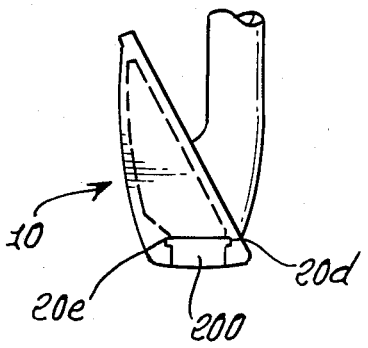
Figure 8:
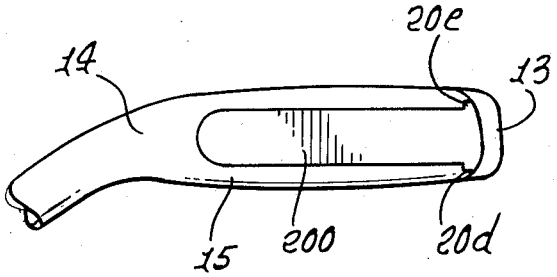
Figure 9:
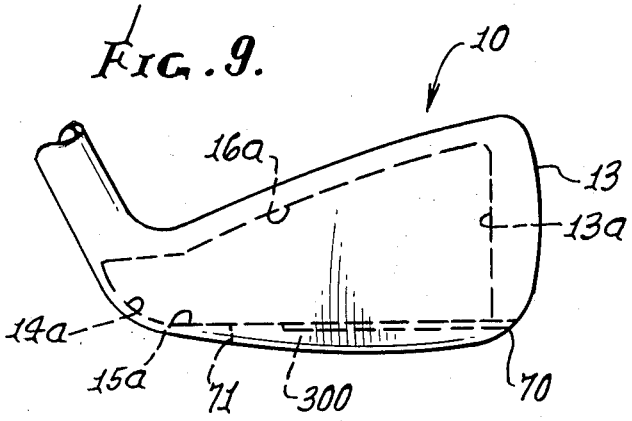
Figure 11:
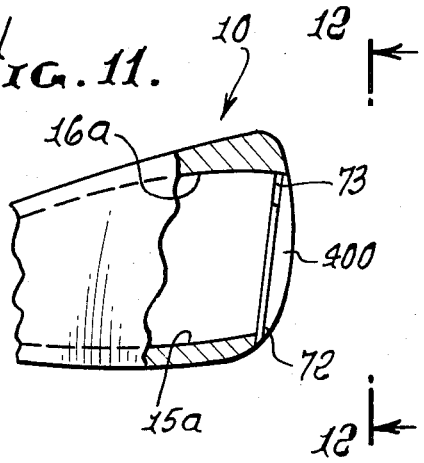
Figure 10:
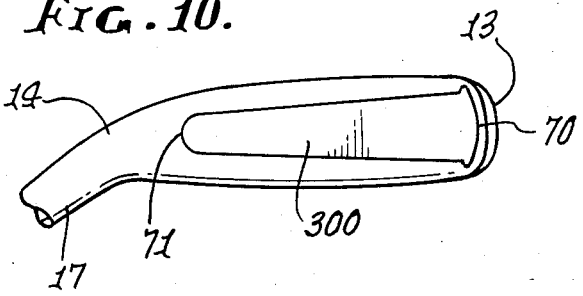
Figure 12:
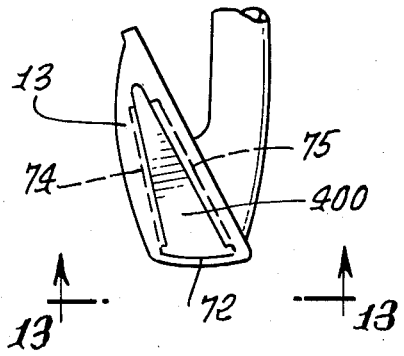
Figure 14:
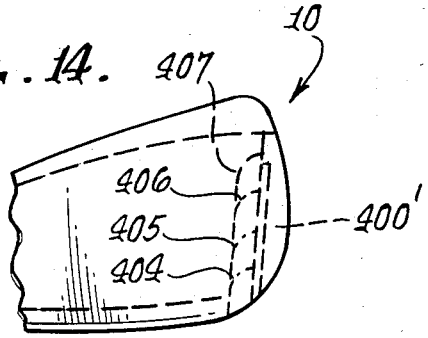
Figure 13:
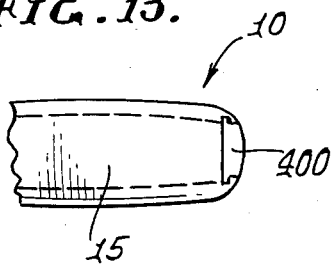
Figure 16:
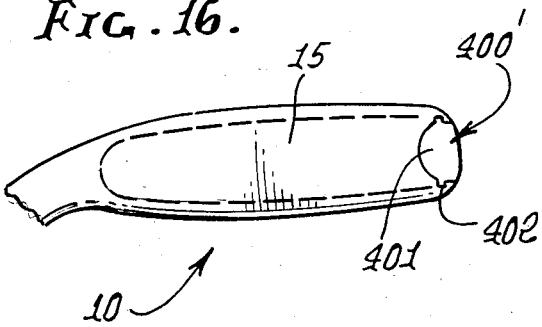
Figure 15:
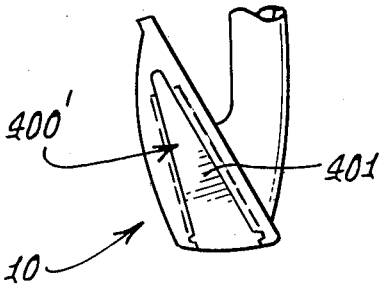
Figure 17:
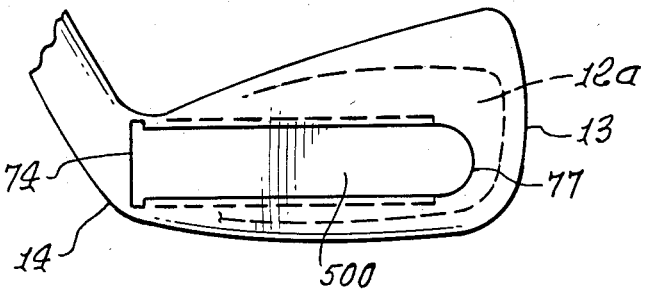
Figure 18:
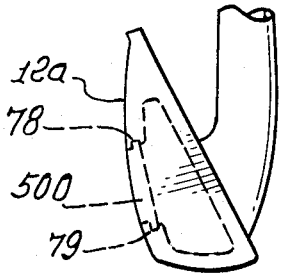
Figure 19:
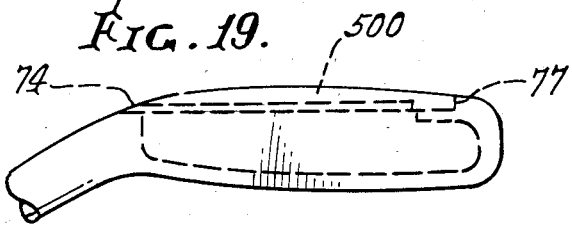
Figure 20:
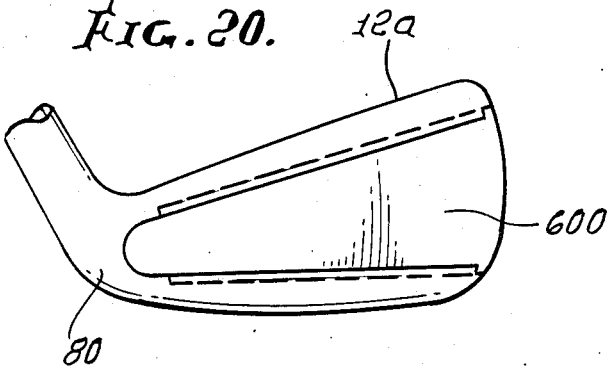
Figure 21:
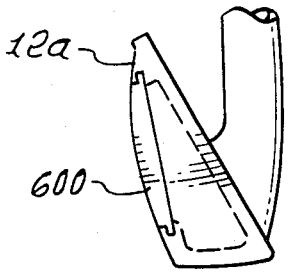
Figure 22:
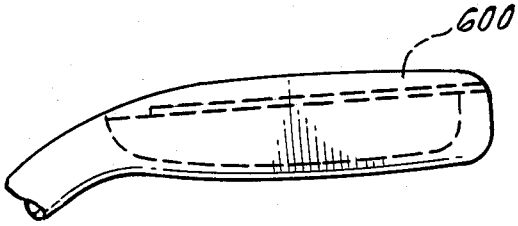
Figure 23:
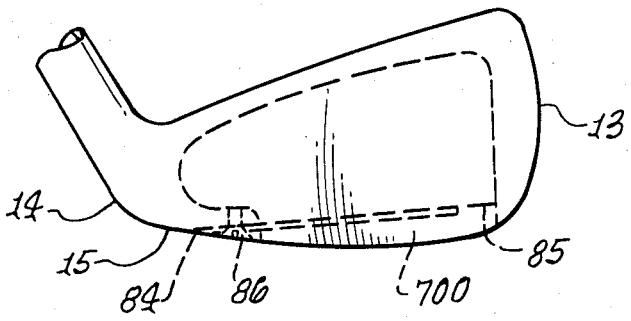
Figure 24:
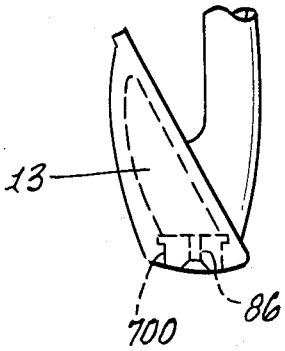
Figure 25:
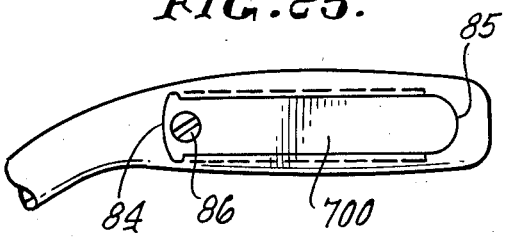
Figure 33:
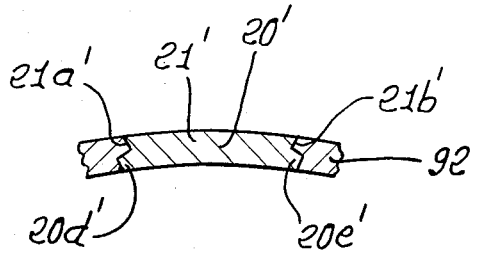

FIG. 2*a* is an enlarged fragmentary section;

FIG. 3 is a bottom plan view taken on lines 3—3 of FIG. 2;

FIG. 4 is a view like FIG. 1, but showing tooling associated with the head; and FIG. 5 is a view like FIG. 2, showing tooling associated with the head;

FIGS. 6–8 are views like FIGS. 1–3, respectively, and showing a first modification;

FIGS. 9 and 10 correspond to FIGS. 6–8, and show a second modification;

FIGS. 11–13 are views like FIGS. 6–8, and show a third modification;

FIGS. 14–16 are views like FIGS. 6–8, and show a fourth modification;

FIGS. 17–19 are views like FIGS. 6–8, and show a fifth modification;

FIGS. 20–22 are views like FIGS. 6–8, and show a sixth modification;

FIGS. 23–25 are views like FIGS. 6–8, and show a seventh modification;

FIGS. 26–29 are front elevation, bottom plan, left end elevation and right end elevational views of a putter head incorporating the invention; and FIGS. 30–32 are front elevation, top plan, and left end elevation views of a wood head incorporating the invention; and FIG. 33 is a fragmentary section.

DETAILED DESCRIPTION

Referring to FIGS. 1–3, the golf iron head 10 has a ball striking front face 11, rear side 12, toe 13, heel 14, bottom wall 15, top edge 16 and hosel 17. While a "five" iron is shown, the "number" of the iron can range between one and nine, and the invention can be incorporated into specialty irons such as "wedges", etc.

The head 10 furthermore comprises a hollow metallic shell, the inner surfaces of the shell including front inner surface 11*a*, rear inner surface 12*a*, forward inner surface 13*a* inward of toe 13, rearward inner surface 14*a* inward of the heel 14, bottom inner surface 15*a* upward and inward of bottom wall 15, and top inner surface 16*a* downward and inward of edge 16. Surface 11*a* is typically substantially parallel to front face 11, and in a generally flat plane; surface 12*a* is generally parallel to surface 12 and in a curved plane, and surfaces 11*a* and 12*a* taper upwardly toward inner surface 16*a*, as shown. Thus, the hollow 18 formed between surfaces 11*a* and 12*a* tapers upwardly, as shown, in a typical head.

The shell defines an opening between hollow 18 and the exterior; and a closure is provided for that opening, the closure having elongated, tongue and groove, linear sliding connection with the head. In the example, the opening 19 is at the bottom of the head, to extend through the bottom wall 15, between the lower extent 13*b* of toe 13, and a locus 19*f* just forward of the heel 14, so that the length of the opening 19 is between 60% and 80% of the total length of bottom wall 15, between toe lower extent 13*b* and heel 14.

The closure 20, as shown, fits the opening along its length, so that it too has the length of the opening 19; further, the closure has a substantially T-shaped cross section in planes normal to the longitudinal length direction of the closure. Note that closure stem 21 has opposite sides 21*a* and 21*b* closely facing opposite sides 19*a* and 19*b* of opening 19; also, the closure stem has a bottom surface 20*c* flush with the bottom surface 15 of the head, the surface 20*c* extending lengthwise medially of surface 15, whereby portions of surface 15 extend at the opposite sides of surface 20*c*.

The T-shaped cross section includes tongue elements 20*d* and 20*e* on the closure that closely interfit T-shaped groove elements 21*d* and 21*e* formed by the head, and between walls 19*a* and 19*b* and the hollow 18, and as shown. Thus, two pairs of tongue and groove elements are provided, each pair including one element on the closure, and the other on the head. The tongue and groove elements are longitudinally elongated, whereby the closure slides longitudinally into place, in a slide direction as indicated by arrow 22 in FIG. 1, the end 20*f* of the closure butting against the end 19*f* of the opening 19. FIG. 3 shows the tongues 20*d* and 20*e* exposed slightly at the toe end of the closure. FIG. 2*a* shows adhesive bonding agent 23 as for example epoxide, that is, an epoxy resin between the outer side surfaces of the closure 20 and the corresponding inner surfaces of the opening 19, melted metal welding also being usable. In FIG. 33, the stem 21' of closure 20' has dovetail shaped opposite sides 21*a'* and 21*b'*, outwardly of tongues 20*d'* and 20*e'*.

Such closure may be of different or selective densities, to facilitate best weighting of the iron; thus, while the head may consist of stainless steel, the closure may consist of brass, or other metal. Alternatively, the closure may comprise two or more sections, as indicated at 19*g* and 19*h* in FIG. 3 abutting one another endwise at edge 26, each section comprising a different metal or alloy, whereby the best weight distribution is obtained longitudinally of the head length. Also, the closure may carry a weighted portion (see for example tungsten carbide weight 27) embedded or cast in the closure metal, and located at a selected position lengthwise of the head, the weight having different density than the closure metal. Since the head is hollow at 18 and the weight is associated with the closure, the resultant center of mass of the head is desirably lowered, and is selectable. The closure closes the head hollow and provides desired weight, and weight distribution.

Referring now to FIGS. 4 and 5, the method of forming the hollow in the head, will now be described. In FIG. 5, multiple inserts 40 and 41 having blade shape and, fitting together in face to face relation at 42, are employed to form and fill a hollow 18' corresponding to hollow 18 in FIG. 2. Thus, their outer sides 40*a* and 41*a* correspond to surfaces 11*a* and 12*a* in FIG. 2. Wax is then formed about the inserts, as within a cavity in a mold 43, and to have an exterior in the shape of the golf iron head 10 in FIGS. 1–3, the mold cavity 44 having that shape. The mold includes sections 43*a* and 43*b*, with a parting line at 45.

After the wax is poured into the mold and hardens to form a replica of the head 10, the mold sections are removed, and the inserts are removed one at a time, and carefully, via the opening 46 formed in the bottom of the wax replica. Opening 46 corresponds in shape to opening 19 in FIGS. 1–3. The wax is then employed in the lost wax process to form a steel head (i.e., the wax is successively dipped in ceramic to build up a ceramic mold and core, and steel is cast into the mold and core, cooled, and the mold and core removed).

FIG. 5 shows the employment of another insert in the form of a temporary closure 48 for opening 46, the wax being formed about that closure as at 49 and 50. That closure is slid out endwise and relative to the wax, to open the opening 46, prior to careful removal of the blade-like inserts, one at a time, from the hollow 18'. The wax and closure 48 have the same T-shaped temporary joinder along the direction of sliding removed of the closure, as described above and shown in detail in FIG. 2*a*. Note recesses 51 in the closure wall, the temporary closure slideout direction indicated at 52.

Referring now to FIGS. 6–8, the construction is the same as in FIGS. 1–4, except that the T-cross section closure 200, which is located to intercept the head bottom 15, is curved along its length, and may or may not conform to the curvature of the bottom wall 15. The tongue and groove elements are also curved along the length of the closure, as shown. The closure curvature is downwardly convex, and may be radial with respect to a center above the head in FIG. 6. The head hollow.

In FIGS. 9 and 10, the construction is the same as in FIGS. 1–4, except that the T-cross section closure 300 is tapered, lengthwise and from a point 70 neat the toe of the head to a point 71 near the heel.

In FIGS. 11–13, the construction is the same as in FIGS. 1–4, except that the closure 400 is confined to the toe end of the head 10; also, the T-cross section closure is tapered along its length from a point 72 near the bottom of the head to a point 73 near the top of the head. It slides into position, endwise upwardly in the toe, there being tongue and groove interconnection, as indicated generally at 74 and 75, and in the manner as shown in FIG. 2a. Again, the head is hollow.

In FIGS. 14–16, the construction is again like that of FIGS. 11–13, and in addition the modified closure 400' has body extent 401 projecting or bulging toward the head hollow interior, to provide metallic weighting at the toe end of the head. The degree of such bulging, which is beyond the T-section sliding interfit as at 402, is selected, as for example by the golfer, to provide the desired degree of weighting; thus, he may have a series of such closures, each with a different degree of closure bulge, and he may try each to arrive at the preferred one which gives best results in play of the club. Also, and as shown in FIG. 14, the bulge may have selected length relative to the full length of the closure as indicated by broken lines 404–407. This variable weighting system 401–407 may be employed in any of these assemblies.

In FIGS. 17–19, the construction is the same as in FIGS. 1–4, but the closure 500 is confined at the rear or back side of the head, being inserted in rear wall 12*a*, and endwise from a point 74' near the heel 14, to terminate at a point 77 short of the toe 13. Again, the closure and head rear wall have T-shaped cross section interfit, as in FIG. 2*a*. See the interfits at 78 and 79 in FIG. 18. The closure may be straight, as shown, or tapered, as in FIG. 10. In FIGS. 20–22 the closure 600 is also inserted endwise in the rear wall 12*a* of the head; however, it is inserted from the toe end toward the heel, to terminate at a point 80 short of the heel, and the closure is tapered in that direction, as shown.

In FIGS. 23–25, the construction is the same as in FIGS. 1–4, except that the elongated insert 700 is located at the bottom of the head; it is inserted in a direction extending generally toward the toe, and extends from the entrance point 84 near the heel to terminate at a point 85 spaced from the toe 13. Means is provided to retain the closure in position, and may advantageously comprise a fastener 86 extending through the closure near point 84, and into the head. The fastener may be removed to permit use of other such closures of different and selected weight.

Figure 26:
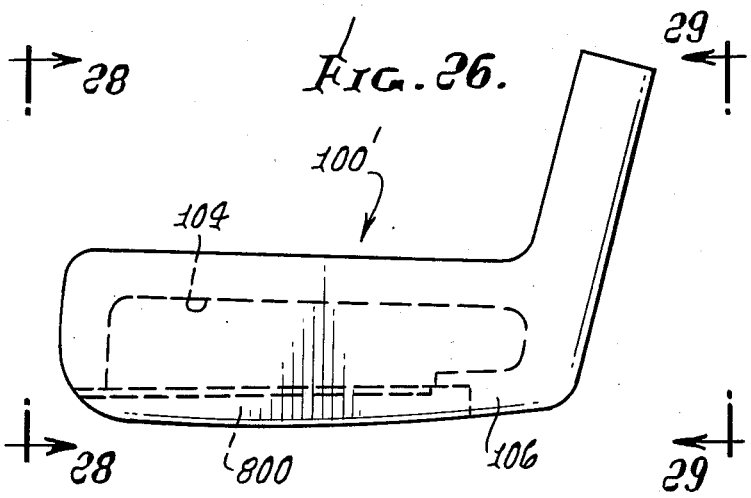
Figure 28:
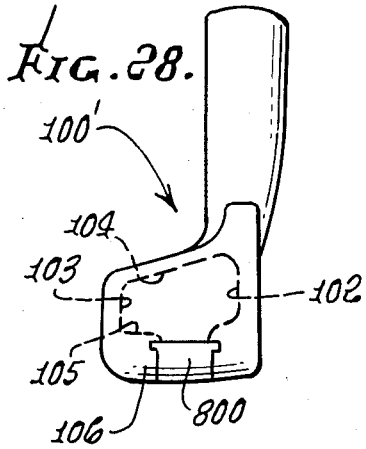
Figure 29:
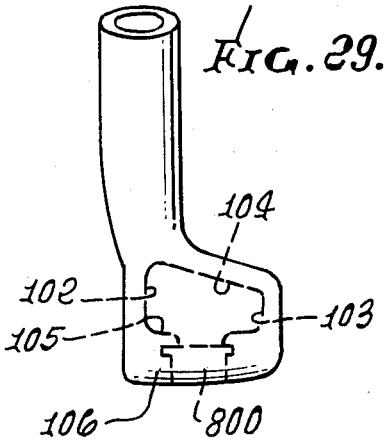
Figure 27:
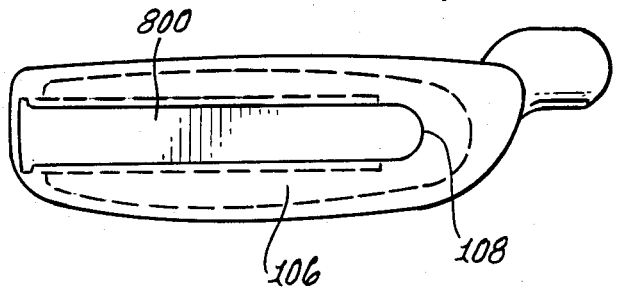

FIGS. 26–28 show the invention applied to a putter head 100' which is hollow (see walls 102–105). The elongated closure 800 is like that shown in FIG. 2*a*, and is inserted in the bottom wall 106 of of the head, to terminate at 108. Its bottom surface is flush with the head bottom wall surface.

In FIGS. 30–32, the invention is applied to a golf wood head 100'', which is hollow (see walls 110–113). The elongated closure 900 is generally like that shown in FIG. 2*a*, but wider, and is inserted in the bottom wall 114 of the head, and toward the toe, to terminate at 115. Its bottom surface is flush with the head bottom wall surface. Head 100'' may consist of metal, such as steel. The tongue and groove interfit of the closure the wall or walls of the head is the same as in FIGS. 1–3.

As will be understood, the invention enables the provision of multiple of the hollow gold club heads and T-shaped, endwise removable or selectable closures for the heads, whereby the golfer may be provided with optimum matched weighting of the clubs in his set, and such weighting may be easily changed, as desired, during the life of the club set. Accordingly, a very flexible weighting system is provided.

The method of achieving desired weighting of different club heads in a set, may then advantageously include the following steps:

(i) sliding different of said closures having different weighting in the multiple heads, (ii) the golfer then swinging the clubs to determine the feel of the clubs, (iii) and repeating said (i) and (ii) steps to arrive at optimum weighting of the heads in terms of optimized club swinging feel.

In this regard, "performance" may include hitting a gold ball during such swinging.

In FIG. 33, wall 92, may be any wall of the head, including the front wall, as seen in FIG. 30.

We claim:

1. In a golf iron, the combination comprising (a) means defining a hollow metallic head having a ball striking front face and a bottom surface, (b) the head defining an opening between the hollow and the exterior, the opening located at the bottom of the head, the head having a heel and toe, (c) and a closure for said opening having elongated, tongue and groove, linear sliding connection with said means, said closure located at the bottom of the head, the closure directly exposed along its length to the head hollow above the closure, (d) said connection having a substantially T-shaped cross section, the closure being longitudinally elongated in the direction between said heel and toe, and said connection comprising two pairs of tongue and groove elements, each pair including a tongue element on the closure and a groove element on said head, the grooves having shoulders adjacent the head hollow to limit inward displacement of the tongue elements, and the closure having a lowermost outer surface everywhere spaced from said tongue and groove elements and flush with said head bottom surface at opposite sides of the closure lowermost outer surface, the closure entirely confined within the outer perimeter outline of the head.

2. The combination of claim 1 wherein said head hollow has a shape that corresponds generally to the shape of the iron head.

3. The combination of claim 1 wherein said means consists essentially of steel and brass, and said closure is selected from the group that consists essentially of steel and brass.

4. The combination of claim 1 including a bonding agent bonding said closure to said means.

5. The combination of claim 4 wherein said bonding agent consists of an epoxy resin which extends to said tongue and groove connection.

6. The combination of claim 1 wherein said opening and said closure have lengths between 60% to 80% of the length of said bottom wall between head toe and heel.

7. The combination of claim 1 wherein the closure comprises at least two sections, consisting of different metals or metal alloys.

8. The combination of claim 1 wherein the closure carries a selected weight of a density different from that of the material forming said closure.

9. The combination of claim 1 wherein the closure is curved lengthwise to conform to the bottom curvature of said head.

10. The combination of claim 1 wherein the closure is tapered, lengthwise.

11. The combination of claim 1 wherein the closure extends from a point near the heel to terminate at a point spaced from the toe, there being means retaining the closure in position at the bottom of the head.

12. The combination of claim 11 wherein said retaining means comprises a removable fastener.

13. A set of golf clubs each of which includes a head as recited in claim 1.

14. The combination of claim 1, wherein the closure includes a stem having parallel opposite sides from which said tongues project oppositely.

* * * * *